United States Patent [19]

Holcomb

[11] Patent Number: 4,688,395

[45] Date of Patent: Aug. 25, 1987

[54] SELF-CONTAINED COOLING DEVICE FOR FOOD CONTAINERS

[75] Inventor: Robert R. Holcomb, Hamilton, Ala.

[73] Assignee: Superior Marketing Research Corp., Salt Lake City, Utah

[21] Appl. No.: 881,386

[22] Filed: Jul. 1, 1986

Related U.S. Application Data

[63] Continuation-in-part of Ser. No. 783,664, Oct. 3, 1985, abandoned.

[51] Int. Cl.[4] ..... F25D 3/10

[52] U.S. Cl. ..... 62/294; 62/457

[58] Field of Search ..... 62/4, 294, 457, 293, 62/371

[56] References Cited

U.S. PATENT DOCUMENTS

| | | | |
|---|---|---|---|
| 2,460,765 | 2/1949 | Palaith | 62/294 |
| 3,269,141 | 8/1966 | Weiss | 62/294 |
| 3,309,890 | 3/1967 | Barnett et al. | 62/294 |
| 3,320,767 | 5/1967 | Whalen | 62/294 |
| 3,379,025 | 4/1968 | Donnelly | 62/4 |
| 3,494,141 | 2/1970 | Irwin et al. | 62/294 |
| 3,494,143 | 2/1970 | Barnett et al. | 62/294 |
| 3,525,236 | 8/1970 | Solhkhah | 62/294 |
| 3,597,937 | 8/1971 | Parks | 62/294 |
| 3,636,726 | 1/1972 | Rosenfeld | 62/294 |
| 3,726,106 | 4/1973 | Jaeger | 62/294 |
| 3,759,060 | 9/1973 | Chase | 62/294 |
| 3,842,617 | 10/1974 | Chase et al. | 62/294 |
| 3,852,975 | 12/1974 | Beck | 62/294 |
| 3,919,856 | 11/1975 | Beck | 62/294 X |
| 3,987,643 | 10/1976 | Willis | 62/371 |
| 4,319,464 | 3/1982 | Dodd | 62/294 X |

*Primary Examiner*—Lloyd L. King

*Attorney, Agent, or Firm*—Mallinckrodt & Mallinckrodt

[57] ABSTRACT

A self-contained cooling device for use in a container such as a food container to cool the contents of the container at any desired time includes a reservoir containing pressurized fluid. The reservoir is secured to the inside of the container to form an expansion chamber between the reservoir and the container. A tube communicates with the reservoir and extends into the expansion chamber, the tube normally being closed to prevent escape of pressurized fluid from the reservoir. When it is desired to cool the contents of the container the tube is opened so that pressurized fluid from the reservoir expands into the expansion chamber thereby cooling the expansion chamber, reservoir, and contents of the container. Embodiments of the device shown specifically are adapted to be used with commonly used "pop-top" beverage cans and in such instance the tube extends to securement with the tab used to operate the "pop-top" or with a separate tab, and operation of the tab causes opening of the tube in the expansion chamber. The device may be secured to the end of the normal "pop-top" can and the reservoir is generally conical in configuration, so can easily be inserted into the filled beverage can by high speed canning equipment as the end is placed on the can and sealed. A further embodiment of the device is shown specifically adapted for use and reuse in an insulated food container.

29 Claims, 12 Drawing Figures

SELF-CONTAINED COOLING DEVICE FOR FOOD CONTAINERS

RELATED APPLICATIONS

This is a continuation-in-part of U.S. patent application Ser. No. 783,644, filed Oct. 3, 1985, now abandoned.

BACKGROUND OF THE INVENTION

1. Field

The invention is in the filed of self-contained cooling devices formed within or adapted to be inserted within a beverage or food container for cooling the contents of the container.

2. State of the Art

Because of the custom of drinking mass quantities of cold liquids in our present society, great expense and effort is exerted in cooling and maintaining beverages in a cool state. In situations where it is impractical to carry modern refrigeration equipment, it is necessary to use ice, other similar materials, or insulated containers to maintain beverages in a cool state. However, ice and similar material only last for relatively short periods of time and must be continuously replenished. Similarly, insulated containers only maintain their contents cool for a similar relatively short period. In many instances when a cold beverage is desired, if an already cold beverage is not on hand and it is not desired to dilute the beverage by the addition of ice cubes, it is impractical to chill a warm beverage because normal refrigeration units or so-called "ice chests" require time to permit the convection cooling process to fully chill the beverage to a suitable temperature. It is thus desirable to have a beverage or other food container with a self-contained cooling device therein that can rapidly chill the container contents when desired without the need for external refrigeration units or "ice chests".

Various attempts have been made to provide cooling devices within a food container. Such devices have generally used a chemical reaction or an expanding gas to provide the required cooling. However, most of these previous attempts at self-cooling containers have resulted in devices that are formed as part of the container itself, requiring that special containers be made to accommodate the cooling devices. This necessitates a totally new design for such a container, and, usually a new design for the canning machinery that is used to fill and seal such containers. Examples of such designs are shown in U.S. Pat. Nos. 3,597,937; 3,309,890; 3,636,726; 3,987,643; 3,525,236; 3,319,464, 3,379,025; 3,726,106; and 3,320,767.

Several prior art devices, such as those shown in U.S. Pat. Nos. 3,919,856; 3,269,141; and 3,494,143 are secured merely to one end of a can. However these require a special, extensively modified can end in addition to the end having the normal beverage despensing opening and thus is not compatible with current beverage cans or beverage canning equipment.

In addition to not being compatable with existing cans and canning equipment, most of the prior art designs do not appear to be economical to manufacture and thus, could not be made and installed in a can at a cost which consumers would pay for the convenience of being able to quickly cool a drink at any location. The need remains for a practical and economical, self-contained cooling device that can be used with currently used cans, requiring only minor modification to such cans, and that can be installed in such cans using the present high speed canning equipment.

SUMMARY OF THE INVENTION

According to the invention, a self-contained cooling device adapted to be placed within a container such as a beverage can or a reusable insulated container includes means forming a reservoir and pressurized fluid within the reservoir. Means secure the means forming the reservoir to the inside of a portion of the container, such as the end of a beverage can or cap of an insulated container, and forms an expansion chamber between the reservoir and the outside of the container. The container has means such as an opening therein connecting the expansion chamber to the atmosphere at least during operation of the device. A sealed tube communicates with the reservoir and extends into the expansion chamber and means are provided, operable from outside the container, for opening the tube within the expansion chamber to allow the controlled escape and expansion of pressurized fluid from the reservoir into the expansion chamber, from where it then passes through the opening to the atmosphere.

For use with beverage cans, the reservoir is secured to the end of the can by wall means and the tube communicating with the reservoir extends through the expansion chamber and out through the opening in the end to attachment to the normal "pop-top" pull tab. The tube is crimped or otherwise scored or weakened at a position where it passes through the expansion chamber so that upon raising the "pop-top" pull tab from the end of the can in normal manner to open the can to dispense the beverage, the tube is broken within the expansion chamber to allow escape of the pressurized fluid. The only modification to the can is that the device is secured to the end, the end has an opening therein into the expansion chamber, and the end of the tube is secured to the "pop-top" pull tab. Rather than being secured to the "pop-top" pull tab, a separate handle or tab could be provided to break off the tube, thereby providing both a cooling device opening tab and a "pop-top" pull tab on the same can end.

For use in insulated containers such as Thermos bottles and similar containers, the reservoir is removably secured to one side of the expansion chamber formed in the cap of the container and the tube communicating with the reservoir extends into and ends in the expansion chamber. The tube is crimped or otherwise scored or weakened at a position in the expansion chamber so that upon application of force to the end of the tube, the tube will break to allow escape of pressurized fluid. The means for breaking the tube may be a spring loaded plunger adapted to be depressed by the user when it is desired to activate the device and when depressed, is adapted to contact the end of the tube and break the tube. After use, the depleted reservoir may be removed from the cap and a new reservoir with tube attached secured to the cap. The device is then ready for use again.

The reservoir is preferably pressurized with carbon dioxide. When the tube is opened by breaking it in the expansion chamber, the carbon dioxide escapes and expands thereby initially cooling the tube and the expansion chamber walls, which cooling is transmitted to the reservoir itself, causing the reservoir to cool and at least some of the carbon dioxide to liquify. Then, as the liquid carbon dioxide boils as further pressure is released, the boiling further cools the reservoir. The cool reservoir and expansion chamber walls cool the liquid in the container.

The means forming the reservoir is preferable substantially cone shaped and, when used with a cam, is centered on the bottom the the can lid so that the lid with attached cooling device can be placed on the filled can and sealed in normal manner by currently used high speed canning equipment. The cone shaped reservoir fits into the vortex of liquid in the can caused by the spinning of the can so that splash during the operation is minimized.

THE DRAWINGS

In the accompanying drawings, which illustrate the best mode presently comtemplated for carrying out the invention:

FIG. 1 is a top plan view of a conventional "pop-top" beverage container, modified slightly to accommodate the present invention;

FIG. 2, a vertical section taken along line 2—2 of FIG. 1;

FIG. 3, a front elevation of the cooling apparatus of FIG. 2, shown attached to a conventional "pop-top" beverage can end prior to attachment of the end to a can;

FIG. 4, a longitudinal section taken on the line 4—4 of FIG. 3, showing the cross-sectional shape of the fluid reservoir;

FIG. 5, a longitudinal section taken on the line 5—5 of FIG. 3;

FIG. 6, a longitudinal section taken on the line 6—6 of FIG. 3;

FIG. 7, a top plan view of the end of a beverage container not secured to a can body and showing a second embodiment of the invention;

FIG. 8, a vertical section of the second embodiment of the invention taken on the line 8—8 of FIG. 7;

FIG. 9, a bottom plan view of a metal disc which forms a part of the capillary conduit at the top of the fluid reservoir as shown in FIG. 8;

FIG. 10, a longitudinal section through the upper portion of the fluid reservoir showing the top of the reservoir, with the metal disc of FIG. 9 removed, in bottom plan view;

FIG. 11, a vertical section of a third embodiment of the invention adapted for use in an insulated food container and wherein the reservoir is removable and replaceable so that the device may be reused; and FIG. 12, an exploded view of the container cap of FIG. 11 showing how the cap, reservoir, and holding ring are assembled.

DETAILED DESCRIPTION OF THE ILLUSTRATED EMBODIMENTS

Figure 1:
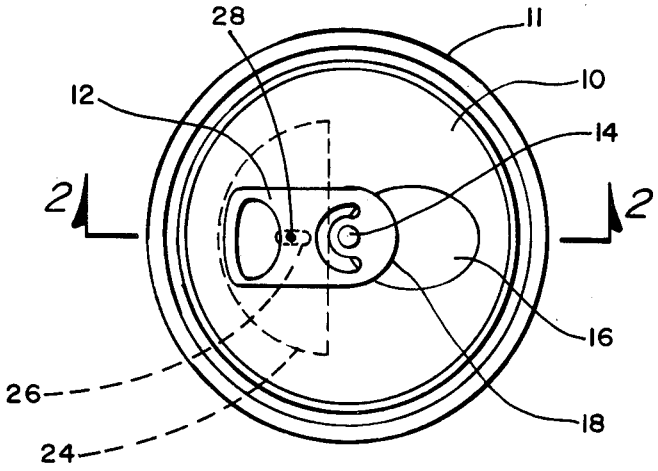
Figure 2:
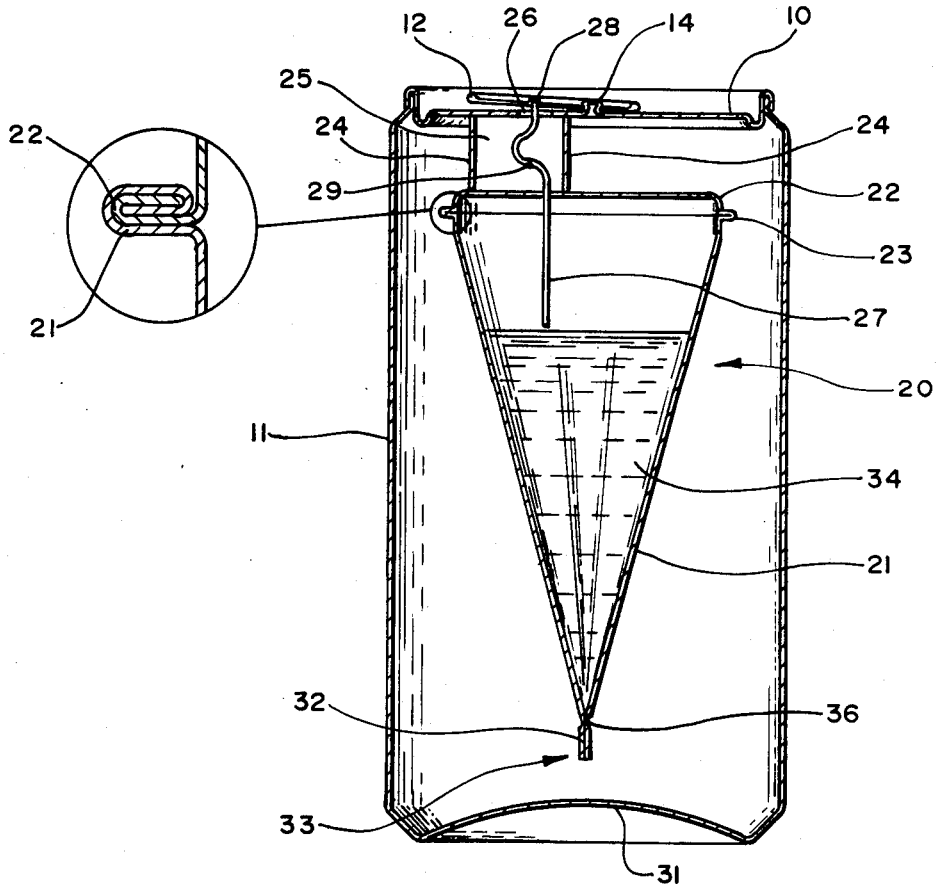

FIG. 1 depicts the top end 10 of a conventional "pop-top" beverage can attached in normal manner to can body 11. The end 10 is slightly modified to accommodate the apparatus of the invention for cooling food or beverage within the can. Two different types of "pop-top" beverage can ends are in common use today. A so called "pollution-free" or environmental type is illustrated in FIGS. 1 and 2, having a manually actuated pull tab 12 affixed to the end by a mounting post 14 formed as an integral part of the end. This particular type of end has an openable closure 16 scored into the end 10, such that when the pull tab 12 is pulled upwardly, it pivots about the portion attached to mounting post 14, causing a front portion 18 of the pull tab 12 to press against the closure 16, which breaks the seal and bends the closure downwardly into the can interior. A second type of "pop-top" is shown in conjunction with an alternative embodiment of the apparatus of the present invention, and will be described herein in conjunction with that embodiment shown in FIGS. 7–10.

Referring to FIG. 2, the device of the invention includes a pressurized fluid reservoir indicated generally as 20. The reservoir 20 is formed by lower wall means 21 and upper wall means 22 joined at double rolled seam 23. Upper wall means 22 also forms the top of the reservoir, as shown. Seam 23, in addition to being double rolled, is also preferably welded in some manner such as pressure welding, electrostatic welding, or otherwise to ensure a strong and air tight bond between the upper and lower wall means.

The reservoir is secured to the end 10 of the can by means of walls 24 which are secured, such as by welding, to the top of the reservoir and to the bottom of the can end. The walls 24 are sealingly secured to the reservoir and end so that together, an expansion chamber 25 is formed. An opening 26 in can end 10 opens the otherwise closed expansion chamber 25 to the atmosphere. Walls 24 may form an expansion chamber of various shapes, the semicircular shape as shown in FIG. 1 being convenient.

A tube 27 extends from inside the reservoir 20, through the expansion chamber 25, and opening 26, and ends at and is secured to "pop-top" tab 12 at an opening 28 in the tab such as by welding. Such welding of the end of the tube also seals the tube to prevent escape of pressurized fluid from the reservoir through the end of the tube. The tube is preferably of small diameter and may be referred to as a capillary tube. Thin walled copper tubing of an inside diameter of between about 0.0012 to 0.005 inch has been found satisfactory, although other materials may also be used.

Capillary tube 27 is crimped or scored at 29 to form a weakened portion of the tube as it passes through the expansion chamber 25 and is bent into a configuration in the expansion chamber so that if "pop-top" tab 12 is raised in a manner to open the beverage can, the capillary tube is broken at crimp 29 so that the tube communicates between the fluid reservoir and the expansion chamber and pressurized fluid can escape through the tube from the reservoir into the expansion chamber. The bend in tube 27 is also such that preferably, once broken, the escaping pressurized fluid will be directed toward the wall at one end of the expansion chamber rather than directly out through opening 26. The size of the capillary tube will determine the rate at which the pressurized fluid can escape from the reservoir. Opening 26 is large enough to allow capillary tube 27 to pass therethrough and to be pulled by tab 12 in a manner to break the tube, and also to allow gas to easily escape from the expansion chamber without building up pressure within the chamber.

Figure 3:
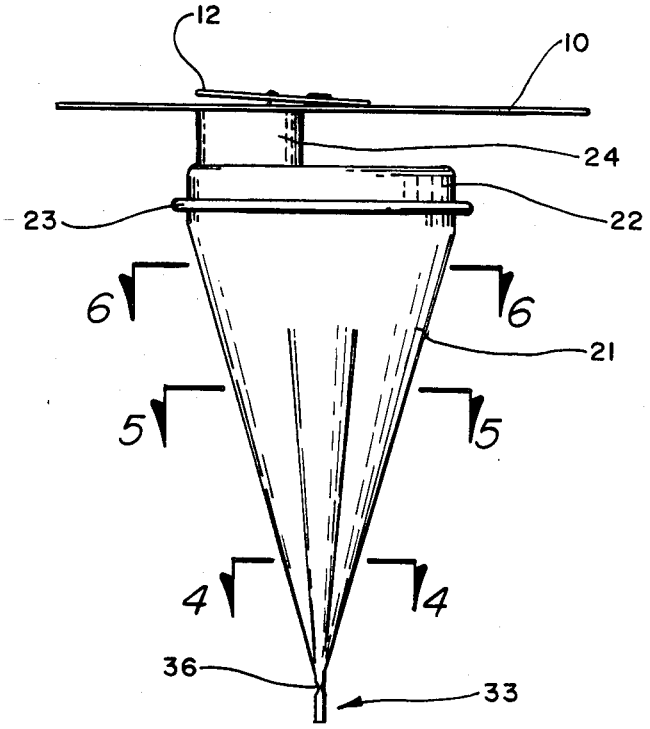
Figure 4:
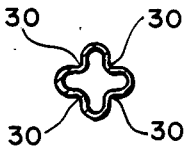
Figure 5:
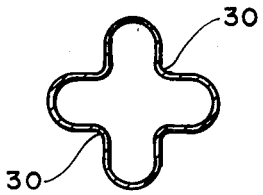
Figure 6:
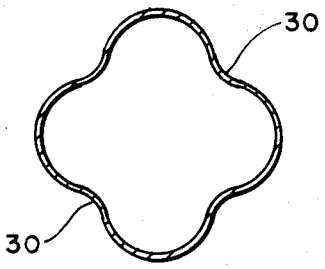
Figure 7:
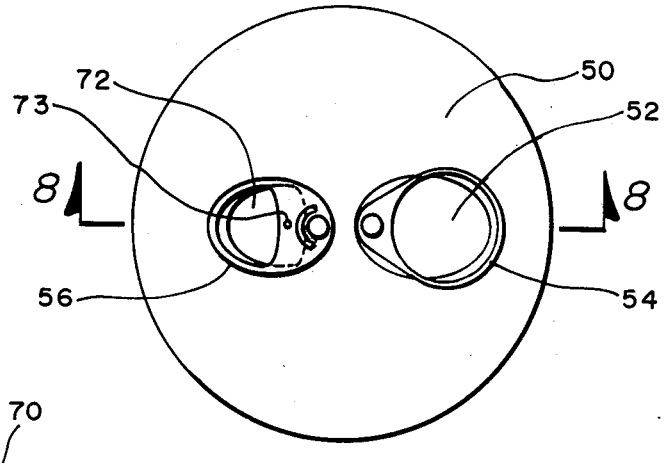

The fluid reservoir is formed with the lower wall means having a generally conical shape as shown in FIGS. 2 and 3, but also having a scalloped cross-sectional shape as shown in FIGS. 4, 5, and 6. The scallop shape is well defined at the apex and mid portion of the cone as seen in FIGS. 4 and 5 and gradually loses definition toward the base of the cone, i.e. the top of the reservoir, FIG. 6, and becomes circular in shape where it joins with top reservoir wall means 22 at seam 23. This scallop shape increases the surface area of the reservoir walls to thereby increase the heat transfer from the can contents to the reservoir during cooling, and also provides a safety factor in the event that the temperature inside the can builds up to a point where the pressure of the fluid in the reservoir would otherwise burst the reservoir. In such instance, the reservoir will expand by bending the scallop valleys 30, FIGS. 4, 5, and 6, outwardly rather than by exploding. In similar manner, if this causes too much pressure inside the can itself, the crown 31, FIG. 2, on the bottom of the can body 11 will bend outwardly to relieve the pressure. The upper and lower wall means of the reservoir may be formed in any suitable manner such as by stamping or extrusion and may be made of aluminum, steel, or other material. It is preferred that the reservoir be adapted to hold pressures up to about 2000 PSI before having the scallops expand as explained above.

The reservoir will be filled with a refrigerant fluid which is under pressure at normal room temperature and which vaporizes under atmospheric pressure at a temperature no higher than the temperature to which it is desired to cool the contents of the can, and preferably significantly below this desired temperature. Although various fluids could be used, it is presently preferred that the fluid used in the reservoir be carbon dioxide. It has been found the filling of the reservoir may be easily accomplished at atmospheric pressure by using carbon dioxide in liquid or solid form. With the embodiment shown in FIGS. 1–6, as first formed, reservoir 20 is open at its bottom as shown by passageway 32. Tube 27 is also open at its end to the atmosphere. During manufacture, the device is attached to a refrigerant supply tube at its end 33 and the refrigerant 34, such as liquid carbon dioxide, flows through passageway 32 into the reservoir. When held in vertical position as shown in FIGS. 2 and 3, the liquid will flow into the reservoir until it reaches the bottom of tube 27, at which time it will begin to flow through tube 27. It has been found that with liquid carbon dioxide, for satisfactory operation of the device and to maintain the pressure inside the reservoir within safe limits, the reservoir should be filled to about 60% of its volume. Thus, tube 27 is positioned to extend into the reservoir a distance such that when the reservoir has been filled to about 60% of its volume with liquid carbon dioxide, the liquid will flow out of tube 27 indicating sufficient filling and preventing substantial overfilling.

The reservoir end 33 is then crimpled as at 36 and welded closed, and the tube 29 is sealed, such as by welding its end closed. The tube 29 could also be crimped at or near its end. In this manner, the reservoir is filled with liquid refrigerant and it is not necessary to vacuum fill the reservoir as in many of the prior art devices. This greatly simplifies the process and lowers production costs considerably. Once filled with the liquid refrigerant and sealed, the refigerant will boil in the reservoir until it reaches an equilibrium pressure for the particular ambient temperature of the reservoir. If the temperature is below 87° F. and the fluid is carbon dioxide, the fluid will generally be partially in a gaseous state and partially in a liquid state. Above about 87° F., the carbon dioxide will generally all be in a gaseous state.

As currently contemplated, production of the device will begin by inserting capillary tube 27, preferably bent and scored to break at the proper location, through a hole punched in the reservoir top wall and brazing to otherwise securing it to the reservoir top wall in a manner to form a pressure tight seal around the tube. The reservoir upper and lower wall means 22 and 21, respectively, are then mated together, their mating annular flanges being double rolled about each other and pressure or electrostatically welded together to form the closed reservoir. Expansion chamber walls 24, as a continuous wall unit, is then affixed to the reservoir top by flash welding or in any other conventional manner.

At this point, the refrigerant reservoir 20 is ready to receive liquid refrigerant. A feeder hose (not shown) is attached to the reservoir end 33 and the rservoir held upright. Liquid refrigerant is pumped into the reservoir until it flows from the top of the tube 27. With the reservoir properly filled, the reservoir end 33 is crimped at 36 and flash welded to seal it, and the end of tube 27 is flash welded to seal it. The unit is now ready to be attached to a "pop-top" beverage container end modified by the provision of opening 26 in the end and opening 28 in the tab. To do this, the upper portion of tube 27 is inserted through the top opening 26 and through attachment hole 28 in pull tab 12. Expansion chamber sidewall 40 is welded or otherwise sealingly attached to the underside of the end 10 in a manner to define the closed refrigerant expansion chamber 25, and the end of tube 27 is welded to pull tab 12. The modified end 10, as shown in FIG. 3, is now ready to be attached to a filled beverage container in the conventional manner.

The cooling device will generally be manufactured and attached to the container end in a central location and then shipped as so assembled to a filling plant where the ends, flat at their edges as shown in FIG. 3, are loaded into filling equipment and placed by such equipment on top of filled cans and than rolled and crimped at their edges to the cans in normal manner to form filled sealed food or beverage cans. The generally conical shape of the refrigerant reservoir 20 provides a primary advantage over other cooling device shapes, in that the conical shape minimizes splash that would otherwise occur when other shaped reservoirs are inserted into filled beverage containers during the high speed canning process. This minimal splash is accomplished because, in the high speed canning process, the liquid filled beverage containers are spinning which results in a vortex being formed in the center of the liquid in the container. With the conical shaped reservoir positioned in the geometric center of the container end 10, the reservoir is inserted into the vortex, thereby delaying actual contact of the reservoir with the liquid until the end 10 is only a short distance from the top of the container 24. In this manner, any liquid splash that does occur is, for the most part, contained within the container by the rapid closing top end. In addition, the conical shape of the reservoir tends to stabilize the reservoir in the vortex and to stabilized the end on the can until actual container sealing takes place. It should be noted that because of the volume of the reservoir inserted into the can, the can cannot be filled as fully as without the device. Generally, the device will require that between 2 to 2½ oz. less beverage be placed in the can prior to filling so that the normal 12 oz. can will only hold about 10 oz when the cooling device is used.

When the can is filled and sealed, it is distributed to consumers in normal manner. To activate the cooling device of the present invention, the user simply grasps the manual pull tab 12 with thumb or finger and pivots it upwardly in normal manner to break open the frangible seal and push the closure tab 16 downwardly into the interior of the container. This upward movement of tab 12 also pulls the end of tube 27 causing tube 27 to break at weakened portion 29 allowing escape of pressurized fluid from fluid reservoir 20 into expansion chamber 25. As the gas expands into the expansion chamber it absorbs heat and causes the tube 27 and expansion chamber wall to cool. This cools the beverage in the container in contact with the expansion chamber walls 24 and also causes cooling by conduction of the attached reservoir walls. This in turn causes cooling of the contents of the reservoir as well as the beverage in contact with such reservoir walls. Continued expansion of fluid through the tube, causes continuing cooling and as gas escapes from the reservoir, the pressure is reduced and any liquid in the reservoir will boil, absorbing heat and further cooling the walls of the reservoir. If no liquid is initially present in the reservoir the initial cooling will generally cause liquid to form. After a suitable cooling times has elasped (approximately one to two minutes) or otherwise after all of the refrigerant has been released into the expansion chamber and been exhausted through opening 26, the beverage may be consumed in the customary manner. The expansion chamber 25 shields the user from the direct stream of pressurized gas and the expanded gas flows harmlessly out through opening 26 to the atmosphere. The smallest inside diameter of tube 27 determines the flow rate of fluid from the reservoir and for a given volume of fluid in the reservoir, substantially determines the time during which fluid flows from the reservoir and during which cooling of the device takes place.

An alternate embodiment of the invention is shown in FIGS. 7–10. This embodiment is illustrated with an alternate type of "pop-top" beverage can end 50 in use today that has a removable, discardable closure 52 attached to a pull ring 54. To open the can, a user grasps pull ring 54 and pulls to remove closure 52 which is then discarded. In this embodiment, a second pull tab 56 is mounted on end 50 and is adapted to operate the cooling device.

Figure 8:
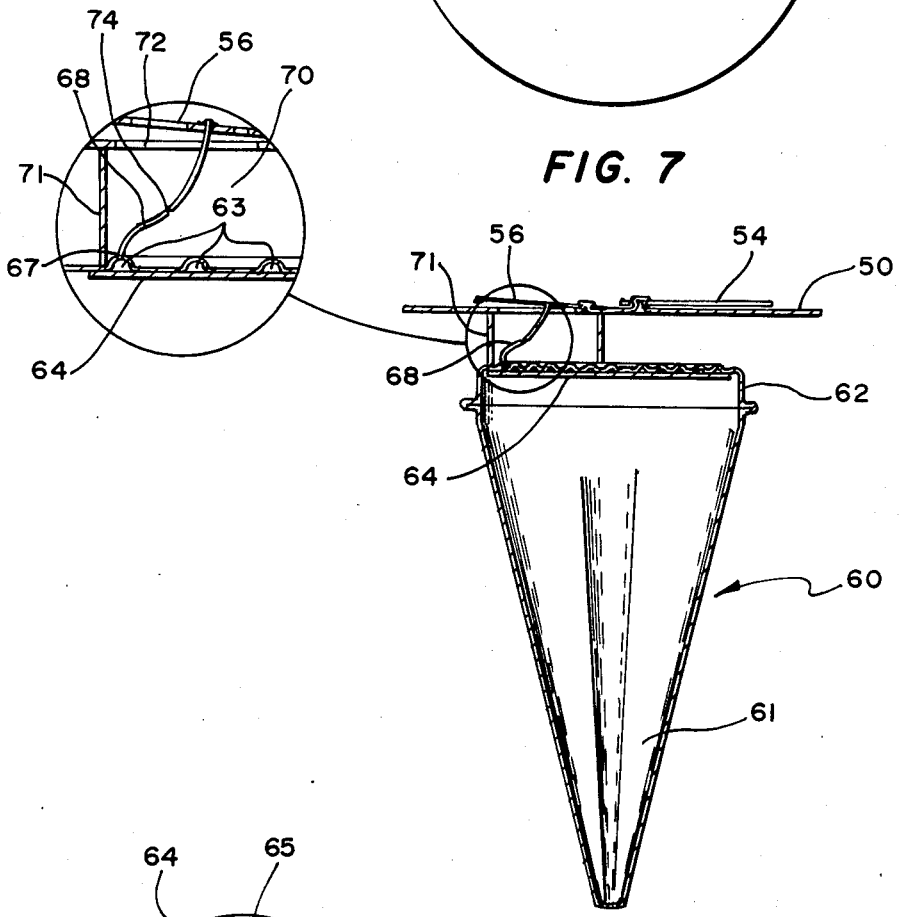
Figure 9:
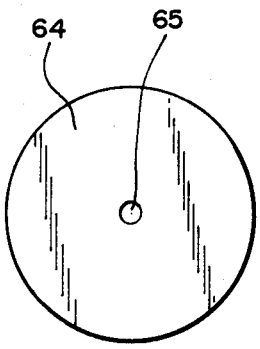
Figure 10:
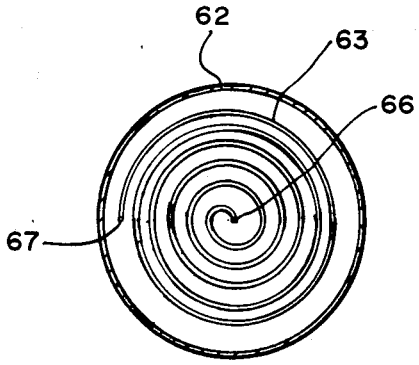

A fluid reservoir 60 similar to that shown in FIGS. 1–6 is formed of a lower wall means 61 and upper wall means 62. The principal difference between the reservoirs is that in the reservoir of FIGS. 7–10, the inside top wall of the reservoir has a spiral groove 63, FIGS. 8 and 10, stamped or machined thereinto. A disc 64, FIGS. 8 and 9, is secured as with adhesive to the inside surface of the upper wall of the reservoir as shown in FIG. 8, with a central opening 65 positioned to communicate with the inner end 66 of spiral groove 63. An opening 67 extends from the outer end of the spiral groove 63 through the reservoir end wall. A tube 68 extends into opening 67 to communicate with spiral groove 63 and extends through an expansion chamber 70 formed by walls 71 which secure reservoir 60 to can end 50, through opening 72 in end 50, to attachment to tab 56 at tab opening 73. Although bent in a somewhat different configuration, tube 68 has a crimped, scored, or weakened portion 74 within expansion chamber 70 adapted to break upon movement of the end of tube 68 in response to movement of tab 56. With the construction described, the spiral groove 63 in conjuction with disc 64 forms a capillary tube or passage that begins at opening 65 in disc 64, and extends along the spiral passage to its end where it meets tube 68. Tube 68 can extend the capillary tube or may be larger in size.

As shown, lower wall means 61 of reservoir 60 has a closed bottom. In this particular embodiment, a block of solid carbon dioxide, i.e. dry ice, is inserted into the reservoir substantially filing the entire reservoir. The upper and lower wall means of the reservoir are then joined in similar fashion as previously described and tube 68 is sealed at or near its end. Walls 71 are secured to reservoir 60 and the end of tube 68 is passed through opening 72 an into opening 73 in tab 56. Walls 71 are secured to top 50 and the end of tube 68 is secured to tab 56 to complete a can end as shown in FIG. 8, ready for use in high speed canning equipment.

While filling the reservoir with dry ice does not provide as much carbon dioxide in the reservoir as filling it with liquid carbon dioxide (when the solid carbon dioxide liquifies it would only fill about 40% of the volume as opposed to the 60% preferred when liquid is used) it has still be found to provide sufficient carbon dioxide and pressure for satisfactory cooling of the can contents. As with the liquid carbon dioxide, once filled, the carbon dioxide will vaporize so that, depending upon the ambient temperature, the carbon dioxide in the reservoir will be mostly in the form of a gas with possibly some liquid.

When installed as part of a sealed beverage can, when it is desired to cool the contents of the can, tab 56 is lifted to thereby break tube 68 at its weakened portion 74. As the gas expands through capillary tube 63 and tube 68 it directly cools the top of the reservoir as well as the walls of the expansion chamber.

The cooling apparatus of the present invention has numerous advantages over prior devices. The primary advantage when used in beverage cans is that the present apparatus enables conventional high-speed canning equipment to be used to insert the apparatus into conventional one piece, all aluminum or steel cans, with little or no modification to such conventional canning equipment being necessary. The present device, being manufactured completely independently of the container and as part of the container top end, eliminates the need to modify the container. This results in substantial savings in implementing the present invention on a commercial scale. Additionally, the present apparatus is adapted to be attached to conventional "pop-top" beverage container ends, with minimal modification to the container end. In the first embodiment, for instance, the only modification necessary is that a hole or slot be punched into the end and into the "pop-top" tab. This can easily be done in the same step in which the end is punched from a sheet of aluminum.

In addition, the generally conical shape of the refrigerant reservoir enables the cooling apparatus to be inserted into conventional one piece beverage containers with minimal liquid splash.

While the two embodiments of the invention have been described in connection with different currently available "pop-top" type can ends, it should be realized that either embodiment may be used with either type end and that with either type end, a single pull tab or two pull tabs could be used. Also the various individual features of either embodiment may be used with features of the other embodiment and the pressurized fluid may be loaded into the reservoir in either solid or liquid form or may be loaded in various other ways, such as by pressure charging.

Figure 11:
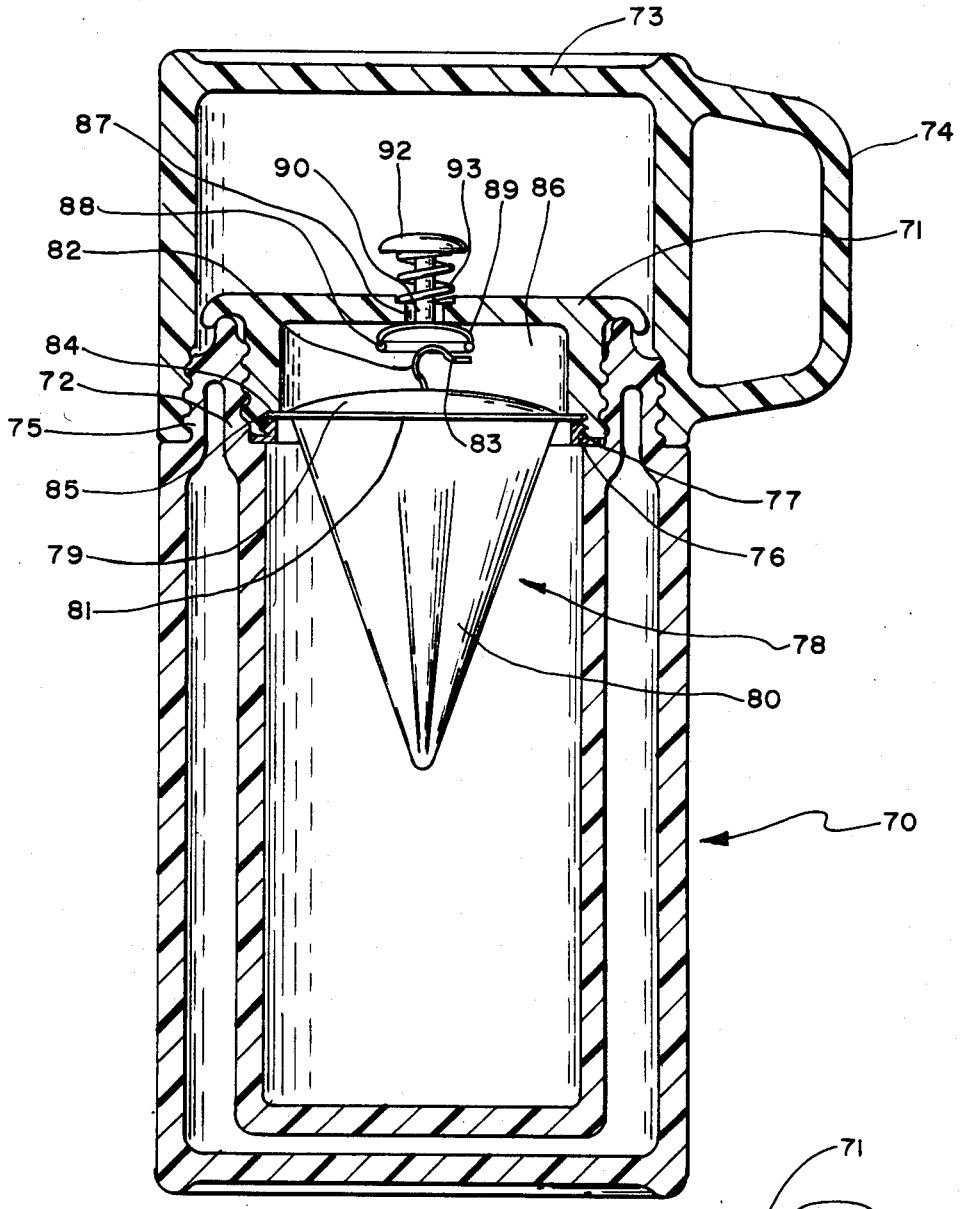
Figure 12:
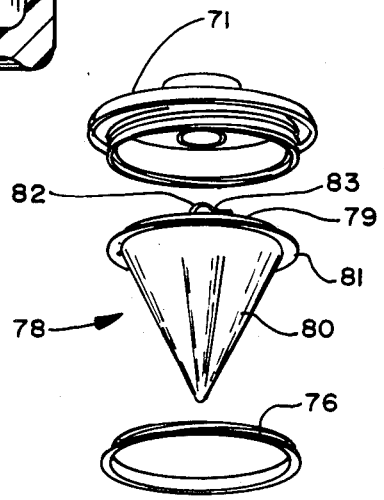

A third embodiment of the invention adapted specifically for use in insulated containers such as Thermos bottles, is shown in FIGS. 11 and 12. A normal plastic double walled insulating container 70 is provided with an inner cap 71 which is threaded into the inner neck 72 of the top of the container. An outer cap 73 which serves as a drinking cut with handle 74 when removed from the container, is threaded onto the outside 75 of the top of the container. So far, a standard container has been described. With the present invention, cap 71 is modified to provide a ring 76 which is removeably threaded to the inside bottom of cap 71 at 77. A reservoir 78 is formed from upper and lower wall section 79 and 80, respectively, which are joined and sealed at flange 81. Tuber 82 communicates with reservoir 78 and extends from the center of the top of the reservoir and is bent outwardly toward the edge of the reservoir as shown. The end of tube 82 is sealed to prevent escape of fluid from the reservoir, but has a weakened portion at 83 adapted to break and open the tube upon breaking force being applied to the end of the tube.

When assembled, reservoir flange 81 mates against shoulder 84 at the lower end of cap 71 and is held in place by shoulder 85 of ring 76 when threaded onto the bottom of cap 71 as shown in FIG. 11. With the reservoir in place, flange 81 forms a seal against shoulder 84 to form an expansion chamber 86 between the top of reservoir 78 and the outside of cap 71. An opening 87 in cap 71 opens the expansion chamber to the atmosphere when cup 73 is removed from the top of the container 70, which occurs during actuation of the cooling device. The tube 82 extends into the expansion chamber 86. A ring 88 is positioned above the end of tube 82 and, since it is a ring, a portion of the ring will always be over the end of tube 82 regardless of its specific orientation. Ring 88 is secured by arms 89 to shaft 90 which extends through hole 87 to the outside of cap 71 where it terminates in button 92. Spring 93 continually urges the button 92 away from cap 71 and ring 88 toward the top of cap 71 away form tube 82.

When it is desired to actuate the cooling device and cool the contents of the container, cup 73 is removed from the container. Button 92 is then pressed downwardly to exert breaking force on the end of tube 82 which causes the tube to break at 83 and allow pressurized fluid from the reservoir 78 to flow out of the tube and expand, cooling the tube and reservoir and contents of the container as explained for previous embodiments. Since the container is insulated, once cooled, the contents of the container will remain cool for an extended period of time.

When it is desired to reuse the container and cooling device, ring 76 is unscrewed from cap 71 and spent reservoir 78 is removed and discarded. A new reservoir is inserted in ring 76 and then secured to cap 71. The device is now ready to be used again to cool the contents of the container.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A self-contained cooling device adapted to be attached to an inside surface of and used inside a container for cooling the contents of the container at a desired time, comprising reservoir means; pressurized fluid within said reservoir means; means securing said reservoir to the inside of the container prior to its closure and forming an expansion chamber between the reservoir and the outside of the container; a closed tube communicating with the inside of the reservoir and extending into the expansion chamber, said tube preventing escape of pressurized fluid from the reservoir means into the expansion chamber but being openable by means operable from outside the container; and means operable from outside the container for opening said tube within the expansion chamber to allow the escape and expansion of pressurized fluid from the reservoir into the expansion chamber, and then to the atmosphere, when it is desired to cool the contents of the container.

2. A self-contained cooling device according to claim 1, wherein the means securing the reservoir to the inside of the container is walls sealingly secured to a portion of the outside of the means forming the reservoir and adapted to be sealingly secured to the inside of the container, and to surround an opening to the atmosphere in the container.

3. A self-contained cooling device according to claim 2, wherein the container with which the device is adapted to be used has an end which is secured to the remainder of the container after the filling thereof and wherein the reservoir means is secured to the end of the container by the walls forming the expansion chamber, prior to the end being attached to the remainder of the container.

4. A self-contained cooling device according to claim 3, wherein the tube extending into the expansion chamber extends through the expansion chamber and is adapted to extend out through the opening in the container; wherein the tube is configured to break at a location inside the expansion chamber to thereby open the reservoir to the expansion chamber upon the application of breaking force thereto; and wherein the means for opening the tube applies breaking force to the portion of the tube adapted to extend through the opening in the container.

5. A self-contained cooling device according to claim 1, wherein the means securing the reservoir to the inside of the container sealingly but removably secures the reservoir at one end of the expansion chamber.

6. A self-contained cooling device according to claim 5, wherein the means securing the reservoir to the inside of the container includes a flange extending about the reservoir which mates with and is held in sealing relationship against a shoulder formed in the container.

7. A self-contained cooling device according to claim 6, wherein a ring is provided to removably hold the flange against the shoulder.

8. A self-contained cooling device according to claim 5 wherein the tube extending into the expansion chamber is adapted to break within the expansion chamber to allow the escape and expansion of pressurized fluid upon the application of breaking force to the end of the tube within the expansion chamber.

9. A self-contained cooling device according to claim 1, wherein the reservoir means has a generally conical configuration.

10. A self-contained cooling device according to claim 9, wherein the reservoir means has a configuration allowing for expansion of the volume of said reservoir if excessive pressure builds up within said reservoir.

11. A self-contained cooling device according to claim 10, wherein at least a portion of the reservoir means has a scalloped configuration to allow expansion thereof.

12. A self-contained cooling device according to claim 1, wherein the pressurized fluid within the reservoir is pressurized carbon dioxide.

13. A self-contained cooling device according to claim 1, wherein the tube communicating with the reservoir is sized to limit the rate of flow of pressurized fluid from the reservoir when the tube is opened.

14. A self-contained cooling device according to claim 1, wherein means is provided to limit the rate of flow of pressurized fluid from the reservoir when the tube is opened.

15. A self-contained cooling device according to claim 14, wherein the means provided to limit the rate of flow is a passageway between the reservoir and the tube the passageway being sized to limit the rate of flow of pressurized fluid therethrough.

16. In combination with an end adapted to be secured to an open ended, filled container to form a closed container and said end having an opening therethrough, a self-contained cooling device comprising reservoir means; pressurized fluid within said reservoir means; walls sealingly secured to a portion of the outside of said reservoir means and to a portion of the end which includes the opening therethrough to thereby secure the reservoir means to the end and to form an expansion chamber between the reservoir means and the end which is open to the atmosphere through said opening; a closed tube communicating with the inside of the reservoir and extending into the expansion chamber; and means operable from outside the container for opening the tube to allow escape and expansion of pressurized fluid from the reservoir into the expansion chamber, and then through the opening in the end to the atmosphere when it is desried to cool the contents of the container.

17. A combination according to claim 16, wherein the tube extending into the expansion chamber extends through the expansion chamber and out through the opening in the end; wherein the tube is configured to break at a location inside the expansion chamber to thereby open the reservoir to the expansion chamber upon the application of force to the portion of the tube extending through the opening; and wherein the means for opening the tube applies the breaking force to the portion of the tube extending through the opening when it is desired to activate the cooling device.

18. A combination according to claim 17, wherein the means for opening the tube is a tab mounted on the end whereby manual movement of the tab applies breaking force to the end of the tube.

19. A combination according to claim 18, wherein the end is a "pop-top" beverage can end and the tab to which the tube is secured is the same tab which is provided to operate the "pop-top".

20. A combination according to claim 18, wherein the end is a "pop-top" beverage can end and the tab to which the tube is secured is a tab provided on the end in addition to the tab provided to operate the "pop-top".

21. A combination according to claim 18, wherein the reservoir means has a generally conical configuration.

22. A combination according to claim 21, wherein the reservoir means has a configuration allowing for expansion of the volume of said reservoir if excessive pressure builds up within said reservoir.

23. A combination according to claim 22, wherein the pressurized fluid within the reservoir is carbon dioxide.

24. A cap adapted to be removably secured to an open container to form a closed container and including a self-contained cooling device operable when desired to cool the contents of the container, comprising reservoir means; pressurized fluid within said reservoir means; means securing said reservoir to the cap so that said reservoir extends from the cap into the container and so that an expansion chamber is formed within the cap between the reservoir and the outside of the cap; a closed tube communicating with the inside of the reservoir and extending into the expansion chamber, said tube preventing escape of pressurized fluid from the reservoir means into the expansion chamber; means in said cap to allow escape of expanded fluid from the expansion chamber to the atmosphere without build up of pressure in the expansion chamber; and means operable from outside the container for opening said tube to allow escape and expansion of pressurized fluid from the reservoir into the expansion chamber when it is desired to cool the contents of the container.

25. A container cap according to claim 24, wherein the reservoir means forms a peripheral flange about the reservoir; and wherein the means for securing the reservoir to the cap includes a shoulder adapted to sealingly mate with the peripheral flange of the means forming the reservoir and means for holding said flange against said mating shoulder.

26. A container cap according to claim 25, wherein the flange is circular and the means for holding the flange is a ring threaded into the cap.

27. A container cap according to claim 24, wherein the tube extending into the expansion chamber is configured to break within the expansion chamber to allow escape of fluid from the reservoir upon the application of breaking force to the end of the tube; and wherein the means operable from outside the container to open the tube is adapted to apply breaking force to the end of the tube.

28. A container cap according to claim 27, wherein the means operable from outside the container includes a ring in the expansion chamber positioned over the end of the tube, means attaching the ring to a shaft extending from the expansion chamber to the outside of the cap, and means for biasing the shaft and ring away from the end of the tube so that application of force to the shaft against the biasing means causes the ring to contact and apply breaking force to the end of the tube.

29. A container cap according to claim 28, wherein the means to allow escape of expanded fluid from the expansion chamber to the atmosphere is an opening through the cap about the shaft.

* * * * *